United States Patent [19]

Metz

[11] 4,112,197

[45] Sep. 5, 1978

[54] MANUFACTURE OF IMPROVED ELECTRICAL CONTACT MATERIALS

[76] Inventor: W. Peter Metz, 1309 Summit La., Mountainside, N.J. 07092

[21] Appl. No.: 766,077

[22] Filed: Feb. 7, 1977

Related U.S. Application Data

[63] Continuation-in-part of Ser. No. 695,971, Jun. 14, 1976, abandoned.

[51] Int. Cl.[2] ..... B21C 23/30

[52] U.S. Cl. ..... 428/629; 29/630 C; 72/258; 148/6.3; 428/632; 428/647; 428/658; 428/673; 428/929

[58] Field of Search ..... 428/592, 614, 628, 629, 428/647, 632, 637, 657, 941, 929, 658; 29/423, DIG. 47, 630 C; 72/258; 75/173 A; 148/6.3, 6.31; 427/125

[56] References Cited

U.S. PATENT DOCUMENTS

| | | | |
|---|---|---|---|
| 3,215,512 | 11/1965 | Coad | 428/592 |
| 3,545,067 | 12/1970 | Haarbye et al. | 428/929 |
| 3,570,118 | 3/1971 | Reynolds et al. | 428/930 |
| 3,579,800 | 5/1971 | Packard | 428/592 |
| 3,625,662 | 12/1971 | Roberts et al. | 428/592 |
| 3,666,428 | 5/1972 | Haarbye | 428/929 |
| 3,932,935 | 1/1976 | Harmsen et al. | 29/630 C |
| 3,969,156 | 7/1976 | Wallbaum | 148/115 R |
| 4,050,956 | 9/1977 | deBruin et al. | 148/31.5 |

OTHER PUBLICATIONS

Ryshkewitch, E.; *Oxide Ceramics,* Academic Press, New York, pp. vii, viii, 3–11 (1960).

Dodd, A.E.; *Dictionary of Ceramics,* Philosphical Library Inc., New York, N. Y. p. 53, (1965).

U.S. Patent Office Classification Manual pp. 106-111.

*Primary Examiner*—L. Dewayne Rutledge
*Assistant Examiner*—Michael L. Lewis
*Attorney, Agent, or Firm*—Lerner, David, Littenberg & Samuel

[57] ABSTRACT

Improved electrical contact materials and a method for manufacturing same are disclosed. The improved materials comprise mechanically elongated billets composed of at least a first metal and the oxide of a second metal. The billets include a plurality of alternating substantially coaxial zones of metal-metal oxide and zones devoid of the metal oxide. The zones devoid of the metal oxide serve as slip zones and render the contact material readily formable into any desired electrical contact shape.

37 Claims, 6 Drawing Figures

MANUFACTURE OF IMPROVED ELECTRICAL CONTACT MATERIALS

This is a continuation-in-part of application Ser. No. 695,971 filed June 14, 1976, now abandoned.

BACKGROUND OF THE INVENTION

The use of metal-metal oxides in the electrical contact industry is well known. Such materials, particularly those of the silver-cadmium oxide family, have the advantage of substantially reducing the tendency for sticking in make-and-break contact applications. Further, electrical contacts fabricated from such materials exhibit good arc interruption characteristics, low contact resistance, and high resistance to electrical erosion. However, certain of such materials such as, for example, silver-cadmium oxide, which have superior functional qualities for electrical contact applications, do not lend themselves to low cost production techniques such as heading. Low formability of such materials tends to result in cracking during the heading operation and an accompanying loss of functional qualities. It is recognized that a high metal oxide content is desirable to cause dispersion hardening and to lend errosion resistance to contacts fabricated from such materials but the adverse effect of the metal oxide on formability has heretofore resulted in a limitation on the percentage of metal oxide possible in the final product.

Various techniques have been disclosed in the prior art for fabricating electrical contacts from such metal-metal oxide materials. For example, in British Pat. No. 1,397,319, there is disclosed a method for fabricating contact shapes by compacting silver-cadmium oxide powder under pressure to form a compacted body, sintering the compacted body and thereafter forming the compacted body into the desired contact shape. This technique has been found to result in three distinct manufacturing problems. First, due to the fact that many integral particles are being consolidated, there is an extremely large surface area which is quite difficult to keep free of contamination. Secondly, during consolidation of the particles, interfaces are formed having random directionality extending to the surface of the consolidated body where they act as stress raisers. Thirdly, the metal oxide particle size and distribution throughout the final product is very non-uniform and therefore difficult to control by virtue of varying oxidation paths inherent when variously sized integral particles are present.

Certain of the problems inherent in the technique noted above have been alleviated to some extent by other prior art techniques wherein a strip of silver-metallic alloy is manufactured by melting and casting bars of the alloy material and then rolling the bars to form strips of approximately the desired shape and thickness of the final product followed by internal oxidation of the strip and, where necessary, a second rolling operation to the final size. Still another technique involves extrusion of a pre-oxidized silver-metallic oxide material in the form of shot-grain or pellets. This technique, which is disclosed in U.S. Reissue Pat. No. Rei 27,075, generally comprises the steps of forming a silver-cadmium metallic shot, internally oxidizing the shot, compacting the oxidized shot, extruding the shot, and cold working the extruded shape to the final desired size.

Most recently, in U.S. Pat. Nos. 3,932,935 and 3,932,936, a method for manufacturing silver-metallic oxide materials from which electrical contacts can be prepared has been disclosed which comprises extrusion pressing an assembled plurality of plates or wires of silver-metallic oxide materials which had been previously prepared by either internal oxidation or powder metallurgical techniques. The extruded product thus produced is said to exhibit good formability when subsequently shaped into an electrical contact. While it is disclosed that the fibrous structure of the metallic oxide stratum that results from this technique will have a favorable effect on the subsequent handling of the extruded product when it is formed into an electrical contact, such stratum exists in only a single plane, thus resulting in less than a complete uniformity of metallic oxide distribution throughout the final product. This lack of complete uniformity can lead to the presence of stress raisers and consequently to an adverse affect on formability.

At present, several hundred different contact materials are presently manufactured in order to fill market requirements. Generally, a number of different functional qualities are needed in the contact material in order to provide the best performance results in a given application. For example, in the household circuit breaker market, silver-molybdenum-tungsten, silver-molybdenum, and silver-cadmium oxide materials are most widely used for the electrical contacts. On the other hand, in the appliance contact market, fine silver, silver-copper alloys, and silver-cadmium oxide materials are used extensively. In either case, each type of refactory material contributes a particular desirable quality to the contact material incorporating same. However, manufacturing limitations often cause compromises to be made and the optimum contact material composition cannot always be used.

Heretofore, the manufacture of composite contact materials has been accomplished by incorporating a desired additive material into the basic metal-metal oxide material in the form of a powder such as disclosed in British Pat. No. 1,397,319 discussed above, U.S. Pat. No. 3,158,469 and U. S. Pat. No. 3,827,883. Alternatively, the material has been incorporated by melting and casting it along with the basic materials into the form of an ingot prior to rolling the ingot to form a slab from which electrical contacts are then manufactured. This latter technique is disclosed in U.S. Pat. No. 3,694,197. It has also been suggested, in U.S. Pat. No. 3,821,848, that composite contact materials can be fabricated by metallurgically bonding a layer of a desired additive material directly to a metal-metal oxide electrical contact.

Each of the prior art techniques for manufacturing composite electrical contact materials suffers from the same drawbacks as those set forth above with respect to the manufacture of electrical contact materials in general. Further, the manufacture of composite electrical contact materials according to the prior art techniques does not result in as uniform a distribution of the additive material throughout the finished product as would be desirable. Again, this lack of complete uniformity can lead to the presence of stress raisers and to an adverse affect on formability, particularly in the case where the additional material is added prior to internal oxidation and becomes partially oxidized as well.

It is therefore an object of the present invention to provide a new method for the manufacture of improved electrical contact materials from metal-metal oxides which do not exhibit the above-noted drawbacks encountered with the presently known prior art techniques.

It is a further object of the present invention to provide improved electrical contact materials having a substantially symmetrical and uniform distribution of metallic oxide throughout and a plurality of substantially symmetrical, coaxial slip zones throughout the material which are substantially devoid of metal oxide, thus resulting in a greater degree of formability without danger of rupture as characteristic in the prior art.

It is still a further object of the present invention to provide a new method for the manufacture of improved electrical contact materials from metal-metal oxides which permits the inclusion of a higher metallic oxide content than possible according to the prior art techniques without sacrificing formability.

Still a further object of the present invention is to provide a new method for the manufacture of composite electrical contact materials which do not suffer from the drawbacks characteristic in the prior art.

SUMMARY OF THE INVENTION

According to the present invention, electrical contact materials are manufactured by providing a metallic alloy strip composed of at least a first metal which has good electrical conductive properties and a second metal which is more readily oxidizable than the first metal and internally oxidizing the strip to obtain a strip which is composed of the first metal and the oxide of the second metal. During internal oxidation of the strip, the center of the strip becomes at least partially depleted of the second metal and is substantially devoid of the metal oxide. Subsequent to internal oxidation, the strip is wound to form a wrapped billet and the wrapped billet is mechanically elongated whereby a ductile metal-metal oxide product is obtained. Mechanical elongation can be effected acording to known techniques such as, for example, by extrusion, swaging, or rod rolling. The product thus obtained can then be shaped according to conventional methods into any desired final contact shape.

Metals having good electrically conductive properties that can be used as the first metal in accordance with the present invention include silver, gold, palladium, platinum, and aluminum. The second material, which will be more readily oxidizable than the first material, can be selected from the group comprising cadmium, tin, zinc, lead, thallium, copper, thorium, indium, titanium, berylium, magnesium, calcium, strontium, barium, uranium, and zirconium. The preferred composition, however, for the final product is silver-cadmium oxide since it is generally recognized as exhibiting the best arc interruption characteristics, low contact resistance, and high resistance to electrical erosion of any other materials presently used in the manufacture of electrical contacts.

The strip of metal-metal oxide material which is to be wrapped and mechanically elongated in accordance with the present invention can be prepared by various techniques including melting and casting a metal-metal alloy into an ingot, rolling the ingot into a strip, and then subsequently subjecting the rolled strip to internal oxidation. However, if desired, the strip can be prepared by blending powders of the first and second metals, sintering the blended powders to form an ingot, and then rolling the ingot to form a strip prior to internal oxidation.

The metallic alloy strip can be subjected to a suitable cleaning operation, either prior to or subsequent to internal oxidation, or both. The shape of the strip, having a relatively small surface area when compared to separate integral particles of material compacted to form electrical contacts according to certain of the prior art techniques, lends itself quite readily to such cleaning and the consequent removal of any surface contaminants.

The internally oxidized metal-metal oxide strip can be wound into a wrapped billet either with or without a center core of a similar metal-metal oxide wire. The cross-secton of the billet can be any desired shape so long as it is wrapped symmetrically about the longitudinal axis of the billet. In any event, it has been found that the resultant product after mechanical elongation exhibits a series of annular laminar flow lines of the oxide material throughout the silver matrix giving a coaxial and symmetrical distribution of the oxide throughout the mechanically elongated billet. It has been found that such a distribution results in superior formability of the mechanically elongated product when compared with metal-metal oxide materials made according to the prior art techniques. Specifically, although not wishing to be bound by any specific theory, it is believed that the superior formability results from the fact that during internal oxidation of the metallic alloy strip, zones depleted of metallic oxide which causes dispersion hardening of the final product are formed, thus leaving slip zones of the first more malleable metal. When the internally oxidized strip is wound to form the wrapped billet, each separate wrap has its own depletion zone thus, in effect, causing a series of coaxial and symmetrical slip zones devoid of the metallic oxide throughout the coiled billet. Basically, since the zones which are devoid of the metal oxide are far more malleable than the disperison hardened metal oxide, the mechanically elongated product will deform symmetrically about the longitudinal axis of the product when it is headed in the direction normal thereto. The slip zones thus enable much more efficient heading than obtainable with contact materials including randomly distributed dispersion hardened areas of the metallic oxide as obtained according to prior art techniques.

As noted hereinabove, while silver-metallic oxide materials manufactured in accordance with the technique disclosed in U.S. Pat. Nos. 3,932,935 and 3,932,936 may exhibit what is said to be a fibrous structure of the metallic oxide stratum and that such structure enhances the formability of products so produced, it can readily be seen that such structure cannot possibly give the coaxial and symmetrical slip zones which extend the entire longitudinal length of the mechanically elongated billet as are obtainable in accordance with the present invention.

Still another feature of the present invention resides in the fact that composite materials can be manufactured by placing additional strips of material in overlying relationship to the basic internally oxidized metallic alloy strip, rolling the strips together to form a wrapped billet, and then subsequently mechanically elongating the wrapped billet. The resultant product will include separate coaxial and symmetrical zones of the additional material alternating with the slip zones of the electrically conductive material of the first sheet and the dispersion hardened zones of metallic oxide. As should be readily apparent, the technique results in extremely uniform distribution of the additional material not otherwise obtainable according to prior art techniques. Furthermore, the same advantages of formability that result from the presence of the slip zones that were discussed above will be obtained as well. Among the materials that contribute the desired characteristics to electrical contacts that can be utilized in conjunction with the present invention are metal-metal oxide of different compositions than those of the basic strip, pure silver, silver graphite, tungsten, silver-tungsten, molybdenum, silver-molybdenum, silver-iron, silver-nickel, gold, platinum, palladium, aluminum, copper, and mixtures of same. Of course, those of ordinary skill in the art can readily determine and utilize whatever additive materials will impart particular desired characteristics to the final product.

It should also be noted that the advantages obtained by the presence of the coaxial and symmetrical slip zones of the present invention can be achieved by alternately stacking sheets of an electrically conductive material such as silver with a dispersion hardened material such as silver-cadmium oxide, rolling the stacked sheets to form a wrapped billet and then mechanically elongating the wrapped billet. The pure silver layer will serve as a slip zone enabling symmetrical heading about the longitudinal axis of the mechanically elongated billet in the same fashion as that set forth above. Of course, any particular combination of materials desired can be wound into the form of a billet and mechanically elongated and the advantages will be obtained so long as at least one of the sheets has good electrical conductive properties and is more malleable than the other materials being utilized.

It is noteworthy that the concept of winding elongated metallic material into a coil prior to extruding same has been disclosed in connection with the production of titanium base metal shapes. Thus, in U.S. Pat. No. 3,579,800 such a technique is utilized under specific conditions directly related to titanium metallurgy, in connection with the manufacture of elongated titanium base extrusions such as tubes and rods, and is said to result in a lessening of stress raisers during such manufacture which lead to cracking or splitting of the rods during subsequent cold-drawing operations. Specifically, the technique involves the steps of orienting a sheet of titanium base metal in its rolling direction so that the elongated grains of the metal are specifically oriented along a first axis, coiling the oriented sheet about a second axis perpendicular to the first axis to provide a plurality of convolutions about said second axis and to form an extrusion billet, and extruding the billet at an elevated temperature in excess of 1200° F. The resulting product is used primarily for tubing in connection with the manufacture of aircraft. It should, however, be clear that although the broad concept of winding a sheet material into a coil prior to extrusion is disclosed, heretofore there was no recognition that such a technique could be applied to the manufacture of electrical contact materials from metal-metal oxides where a uniform distribution of the oxide throughout the final product is required in order to impart to the material a high degree of formability without attendant rupture during manufacture. Further, there was clearly no recognition that the depletion zones of metal oxide which result from internal oxidation of metal-metal alloy strips where the second metal is more oxidizable than the first metal would form slip zones in a product formed by mechanical elongation of wrapped billets of such strips and that the presence of these slip zones would result in enhanced formability of the mechanically elongated product while permitting a higher content of metallic oxide to be present therein than was possible according to prior art techniques for manufacturing electrical contacts.

DESCRIPTION OF THE DRAWINGS

For a fuller understanding of the nature and objects of the present invention, reference should be made to the following description and drawings wherein.

DETAILED DESCRIPION

Figure 1:
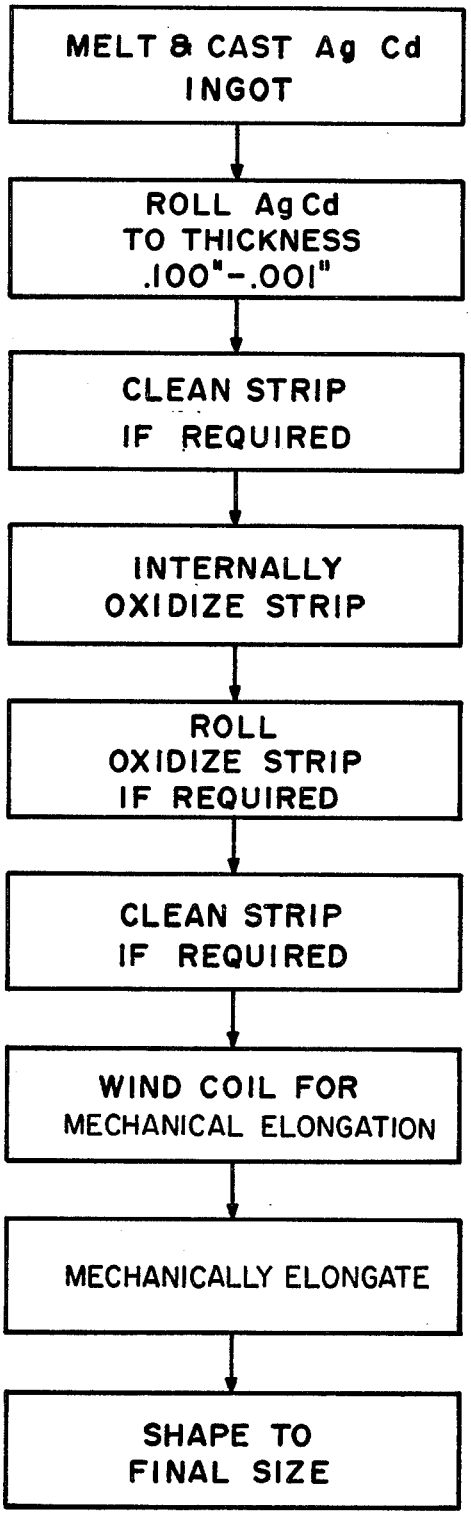
FIG. 1 is a flow diagram setting forth the process steps of a preferred embodiment of the present invention.
Figure 3:
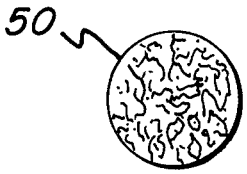
FIG. 3 is a schematic illustration of the macrostructure of a cross-sectional area of an extruded product obtained according to prior art techniques.
Figure 4:
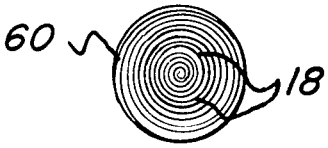
FIG. 4 is a schematic illustration of the macrostructure of a cross-sectional area of an extruded product obtained according to the present invention.
Figure 5:
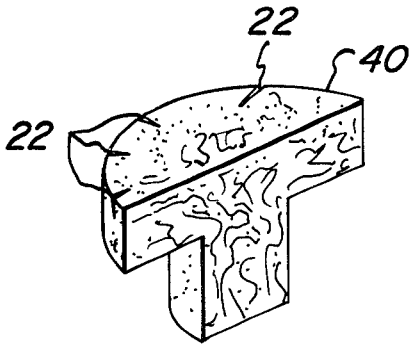
FIG. 5 is a schematic illustration of the macrostructure of a vertical cross-section of an electrical contact manufactured according to prior art techniques.
Figure 6:
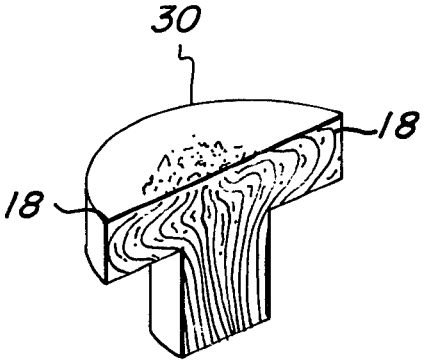
FIG. 6 is a schematic illustration of the macrostructure of a vertical cross-section of an electrical contact manufactured according to the present invention.

In a preferred embodiment of the present invention, as illustrated by the flow diagram in FIG. 1, an ingot of a silver-metallic alloy, preferably unoxidized silver-cadmium, is melted and cast according to known techniques. The alloy constituents will typically range from about 5% cadmium to about 25% cadmium. In addition, other metals can be present such as nickel or cobalt, which result in crystal refinement of the silver in the final product. The particular dimensions for the ingot can be of any size desired so long as such size is suitable for subsequent rolling to form the strip which is to be wrapped.

The silver-metallic ingot is then rolled to a thickness of from about 0.100 inch to .001 inch and then the strip is subjected to internal oxidation under appropriate conditions which are determined by economic considerations as well as the characteristic requirements of the finished product desired. It has been found that the characteristics of the finished product which are related to the particle size and distribution of the cadmium oxide and the silver matrix, are affected to a significant degree by the thickness of the strip during oxidation and stips having a thickness in the aforementioned range have been found to exhibit good results in this regard. During internal oxidation of the rolled strip, the center of the strip becomes at least partially depleted of cadmium and is substantially devoid of any cadmium oxide.

After internal oxidaton is completed, the rolled and oxidized strip is then subjected to a cleaning operation to remove any surface contaminants that may have formed during the oxidation operation. Cleaning can be accomplished by any known chemical or mechanical means. Further, in a preferred embodiment of the present invention, the strip surfaces are cleaned by a suitable cleaning method prior to internal oxidation of the strip as well. The relatively small surface area of the strip, when compared to the separate integral particles of alloy which are compacted to form electrical contact materials according to certain prior art techniques, permits efficient removal of surface contaminants which can adversely affect the properties of the final product.

The oxidized and cleaned strip is then wound into a tightly wrapped billet which can be mechanically elongated according to conventional techniques to form the final product. Typically, the billet will be about 5–20 inches in length and will have a diameter of from about 2–8 inches, the specific diameter being dictated only by the apparatus being utilized to effect mechanical elongation and the desired dimensions of the final product. Further, if desired, a core of silver-metallic oxide wire can be provided at the center of the billet, such core either having been previously fabricated according to the process of the present invention, or obtained by any of the known prior art techniques.

The preferred technique for effecting mechanical elongation of the wrapped billet is extrusion due to the relative efficiency of extrusion versus other techniques for mechanical elongation such as swaging or rod rolling. However, in certain instances it has been found that swaging or rod rolling are to be preferred since such techniques permit a higher utilization of material. In this regard, the extrusion process results in the formation of a butt end on the extruded product which must be removed prior to further processing. Although in the case of many extruded products the butt end can be salvaged and recycled directly, in the context of the present invention this is not possible. The reason for this is that the extrusion billet of the present invention comprises a precious metal-metal oxide which cannot be simple melted down for subsequent recycling. Rather, in order to salvage the valuable precious metal components of the butt end, it is necessary to subject the butt end to an expensive and complex refining operation. Further, in the case of metal-metal oxide products which include cadmium as a component thereof, refining may be impracticable due to the high toxicity of cadmium and the effect on the atmosphere of cadmium fumes or vapors resulting from the refining process. Nevertheless, as can readily be appreciated, where metal-metal oxides which include precious metals such as silver, gold, palladium, and platinum are involved as contemplated with the present invention, the economic significance of simply scrapping the butt end of the extrusion product can become quite significant and refining to salvage the components becomes an economic necessity.

In view of the above and in order to avoid the necessity for refining and possible environmental problems occasioned thereby, the less efficient techniques of swaging and rod rolling can, if desired, be employed to alleviate such problems, the latter techniques permitting total utilization of the material. In any event, the advantages which result from the presence of the slip zones when the elongated product is headed to form an electrical contact, are achieved regardless of whether extruded, swaged, rolled, or otherwise mechanically elongated product is used.

The mechanically elongated billet, typically having a diameter of from about 0.050–2.0 inches, is shaped into a final electrical contact according to standard manufacturing techniques known in the prior art such as heading, or bonding into a rivet or contact. The actual diameter of the billet will, of course, be determined by the particular final manufacturing operation being utilized. In any case, the mechanically elongated product, as well as the final electrical contact manufactured therefrom, will exhibit superior formability and headability to materials obtained according to prior art techniques. As noted above, it is believed that this superior formability results from the presence of the zones depleted of cadmium oxide which result in the formation of slip zones of essentially pure silver after the strip has been wrapped and mechanically elongated. The slip zones permit symmetrical heading of the mechanically elongated product about its longitudinal axis. In this regard, reference to FIGS. 2–6 show quite clearly, by way of comparison with the prior art structures 40 and 50, the existence of the slip zones of silver and the annular laminar flow lines of the oxide material throughout the cross-section of the product as opposed to the relatively random distribution characteristic of materials manufactured according to prior art techniques.

Figure 2:
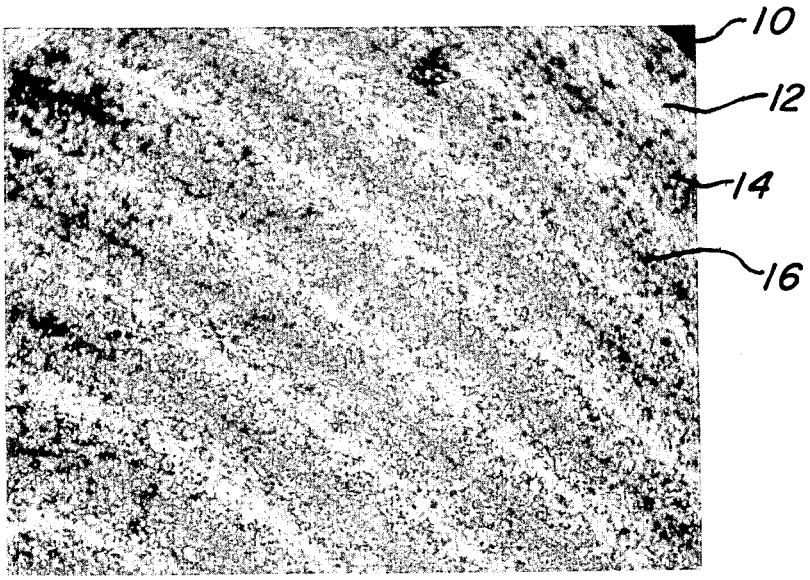
FIG. 2 is a photomicrograph at 100X of a partial cross-section of an extruded billet of silver-cadmium oxide produced in accordance with the present invention.

Specifically, in FIG. 2, the cross-section of an extruded silver-cadmium oxide billet is shown prior to deformation into an electrical contact shape, the edge of the product being indicated by reference numeral 10 and the interface between successive wrappings of the silver-cadmium oxide strip being indicated by reference numeral 16. As can readily be seen, the product comprises depletion zones 12 of essentially pure silver alternating throughout the cross-section of the product with dispersion hardened zones 14 of silver-cadmium oxide.

Generally, when a mechanically elongated product in accordance with the present invention is headed along its longitudinal axis, the depletion zones serve as slip zones resulting in virtually uniform and symmetrical deformation of the billet in the direction normal to the longitudinal axis of the billet. The resultant uniform deformation is believed to be apparent from a comparison of FIGS. 4 and 6. Thus, as represented schematically in FIGS. 4 and 6, the metal deforms quite uniformly about the axis due to the presence of the slip zones 18 which alternate with the dispersion hardened zones so that the slip zones and dispersion hardened zones remain substantially uniformly distributed throughout the formed product resulting in more uniform mechanical and electrical properties in the formed contact. This is to be distinguished from the relatively random distribution of both the electrically conductive material and the dispersion hardened material which is characteristic of the prior art structure portrayed schematically in FIGS. 3 and 5 in which head cracks 22 result during heading.

The following Example will further serve to illustrate the present invention.

A melt of a silver-cadmium alloy containing 86.5% silver, 13.3% cadmium, 0.2% nickel was prepared at approximately 1020° C. The melt was then cast into an ingot having the dimensions 2 × 12 × 24 inches. The ingot was then rolled according to conventional rolling techniques to a thickness of 0.050 inch. Subsequent to rolling, the ingot was coiled with a porous separator in order to hold the wraps apart and was thereafter heated to 750° C. and held for a period of 12 hours at 20 psi in an atmosphere of oxygen. At the end of the 12 hour period the coiled strip was fully oxidized and subjected to a cleaning operation by a strip brushing machine in order to remove excess cadmium oxide and other contaminants which were formed on the surface of the strip. The cleaned strip was then tightly wound onto a ½ inch diameter rod of silver-cadmium oxide which had previously been extruded. The extrusion billet thus produced was 12 inches and had a diameter of 3-½. The billet was then preheated to 500° C. and extruded according to normal extrusion techniques to form a 0.300 inch diameter wire which was then subsequently drawn and annealed to a finished size for subsequent heading or bonding into a rivet or contact.

The wire thus produced had a final composition of about 85% silver and 15% cadmium oxide. This material exhibited superior formability and headability to materials containing only10% cadmium oxide which had been produced according to prior art techniques.

The zones depleted of cadmium oxide which serve as slip zones of pure silver which are distributed symmetrically and coaxially throughout the final product and extend along the entire length thereof, permit the extruded product to be symmetrically headed about its longitudinal axis. The presence of these slip zones, therefore, permits the incorporation of a higher percentage of cadmium oxide in the final product than was possible according to the prior art techniques without any sacrifice of formability. The inclusion of a higher cadmium oxide content contributes to more uniform arc erosion and thus better wear characteristics of contacts formed from such materials. Further, because the materials made in accordance with the present invention can be uniformly and symmetrically headed, the contacts so produced will exhibit better wear characteristics since the arc will distribute evenly rather than focusing on a weak point such as occurs in an electrical contact having a nonuniform configuration of the head. Such uniformity leads to a lower temperature rise during use and therefore to more uniform electrical properties.

While the invention has been described with a certain degree of particularity, it will be understood that the description was by way of example only and that numerous variations and modifications, as may become apparent to those of ordinary skill in the art, can be made departing from the spirit and the scope of the invention as hereinafter claimed.

The embodiments of the invention in which an exclusive privilege or property is claimed are defined as follows:

1. A method for manufacturing electrical contact materials comprising, providing a metallic alloy strip composed of at least a first metal having good electrical conductive properties and a second metal more readily oxidizable than said first metal, internally oxidizing said strip to obtain a strip composed of said first metal and the oxide of said second metal, the center of said strip being at least partially depleted of said second metal during internal oxidation and being substantially devoid of metal oxide to provide a depletion zone composed substantially of said first material and adjacent zones of metal oxide, said depletion zone being more readily deformable than the adjacent zones of metal oxide, winding said strip to form a wrapped billet, and mechanically elongating said wrapped billet to provide a ductile metal-metal oxide product having depletion zones alternating with zones of metal oxide, which depletion zones are disposed symmetrically about the longitudinal axis of said wrapped billet so that said product will deform symmetrically about said axis when headed in the direction normal to said axis.

2. The method of claim 1 wherein said wrapped billet is mechanically elongated by extruding.

3. The method of claim 1 wherein said wrapped billet is mechanically elongated by swaging.

4. The method of claim 1 wherein said wrapped billet is mechanically elongated by rod rolling.

5. The method of claim 1 wherein said first metal is silver.

6. The method of claim 5 wherein said second metal is cadmium.

7. The method of claim 1 wherein said metallic alloy strip is obtained by melting and casting said metallic alloy into an ingot and rolling said ingot to form said strip.

8. The method of claim 1 wherein said metallic alloy strip is obtained by blending powders of said first and second metals, sintering said blended powders to form an ingot and rolling said ingot to form said strip.

9. The method of claim 1 wherein said metallic alloy strip is cleaned prior to internal oxidation of said strip to remove surface contaminants.

10. The method of claim 1 wherein said metallic alloy strip is cleaned to remove surface contaminants prior to winding said strip to form said wrapped billet.

11. The method of claim 1 wherein wrapped billet has a circular cross-section.

12. The method of claim 1 wherein said wrapped billet has a rectangular cross-section.

13. The method of claim 1 wherein subsequent to mechanical elongation, said billet is formed into a desired shape for use as an electrical contact.

14. The method of claim 1 wherein said strip is wound to form said wrapped billet about a core of metal-metal oxide wire.

15. The method of claim 1 wherein said metallic alloy strip has a thickness of from about 0.100 inch to 0.001 inch.

16. A method for manufacturing electrical contacts comprising, melting and casting an ingot of a silver-cadmium alloy, rolling said ingot to form a strip having a thickness of about 0.100 inch to 0.001 inch, internally oxidizing said strip, the center of said strip being at least partially depleted of cadmium during internal oxidation and being substantially devoid of cadmium oxide to provide a depletion zone composed substantially of silver and adjacent zones of cadmium oxide, said depletion zone being more readily deformable than the adjacent zones of cadmium oxide, winding said strip into a billet, mechanically elongating said billet to form a wire of silver-cadmium oxide having depletion zones alternating with zones of cadmium oxide, which depletion zones are disposed symmetrically about the longitudinal axis of said wire so that said wire will deform symmetrically about said axis when headed in the direction normal to said axis, and heading said wire in the direction normal to said axis to form an electrical contact.

17. The method of claim 16 wherein said billet is mechanically elongated by extruding.

18. The method of claim 16 wherein said billet is mechanically elongated by swaging.

19. The method of claim 16 wherein said billet is mechanically elongated by rod rolling.

20. An improved electrical contact material comprising a mechanically elongated billet composed of at least a first metal comprising silver and the oxide of a second metal, said billet including a plurality of alternating first and second zones, said zones extending the entire length of said billet and being substantially symmetrical and coaxial about the longitudinal axis of said billet, said first zones being substantially devoid of metal oxide and said second zones being substantially composed of metal-metal oxide, and said first zones are more readily deformable than said second zones so that said billet will deform symmetrically about its longitudinal axis when headed in the direction normal to said axis.

21. The electrical contact material of claim 20 wherein said billet comprises an extruded billet.

22. The electrical contact material of claim 20 wherein said billet comprises a swaged billet.

23. The electrical contact material of claim 20 wherein said billet comprises a rod rolled billet.

24. The electrical contact material of claim 20 wherein said first zone is composed substantially of said first metal.

25. The electrical contact material of claim 20 wherein said first zone is composed substantially of said first and second metals.

26. The electrical contact material of claim 20 wherein the cross-section of said billet is circular.

27. The electrical contact material of claim 20 wherein the cross-section of said billet is rectangular.

28. The electrical contact material of claim 20 wherein said second metal is selected from the group consisting of cadmium, zinc, and tin.

29. An improved electrical contact material comprising a mechanically elongated billet composed of at least a first metal and the oxide of a second metal, said second metal being selected from the group consisting of cadmium, zinc, and tin, said billet including a plurality of alternating first and second zones, said zones extending the entire length of said billet and being substantially symmetrical and coaxial about the longitudinal axis of said billet, said first zones being substantially devoid of metal oxide and said secnd zones being substantially composed of metal-metal oxide, and said first zones are more readily deformable than said second zones so that said billet will deform symmetrically about its longitudinal axis when headed in the direction normal to said axis.

30. An improved electrical contact material comprising a mechanically elongated billet composed of at least silver and cadmium oxide, said billet including a plurality of alternating first and second zones, said zones extending the entire length of said billet and being substantially symmetrical and coaxial about the longitudinal axis of said billet, said first zones being substantially devoid of cadmium oxide and said second zones being substantially composed of silver-cadmium oxide obtained by internal oxidation of silver-cadmium alloy, and said first zones are more readily deformable than said second zones so that said billet will deform symmetrically about its longitudinal axis when headed in the direction normal to said axis.

31. The electrical contact material of claim 20 further including additional zones alternating with said first and second zones, extending the entire length of said billet and being substantially symmetrical and coaxial about the longitudinal axis of said billet, said additional zones being composed substantially of materials selected from the group comprising metals, metal oxides, metal alloys, and mixtures of same.

32. A method for manufacturing composite electrical contact materials comprising, providing a first metallic alloy strip composed of at least a first metal having good electrical conductive properties, and a second metal more readily oxidizable than said first metal, internally oxidizing said strip to obtain a strip composed of said first metal and the oxide of said second metal, the center of said strip being at least partially depleted of said second metal during internal oxidation and being substantially devoid of metal oxide to provide a depletion zone composed substantially of said first material and adjacent zones of metal oxide, said depletion zone being more readily deformable than the adjacent zones of metal oxide, placing at least a second strip of a material selected from the group comprising metals, metal oxides, metal alloys, and mixtures of same, in overlying relationship to said first strip, said second strip having a composition different from the composition of said first strip, winding said strips to form a wrapped billet, and mechanically elongating said wrapped billet whereby a composite electrical contact material product is obtained having depletion zones disposed symmetrically about the longitudinal axis of said wrapped billet so that said product wll deform symmetrically about said axis when headed in the direction normal to said axis.

33. The method of claim 32 wherein said wrapped billet is mechanically elongated by extruding.

34. The method of claim 32 wherein said wrapped billet is mechanically elongated by swaging.

35. The method of claim 32 wherein said wrapped billet is mechanically elongated by rod rolling.

36. The method of claim 32 further comprising the step of placing at least a third strip of a material selected from the group comprising metals, metal oxides, metal alloys and mixtures of same, in overlying relationship to said first and second strips prior to winding said strips to form said wrapped billet, said third strip having a composition different than the composition of said first strip.

37. The method of claim 32 further comprising the step of placing additional strips of materials selected from the group comprising metals, metal oxides, metal alloys, and mixtures of same in overlying relationship to said first and second strips prior to winding said strips to form said wrapped billet.

* * * * *

UNITED STATES PATENT AND TRADEMARK OFFICE

CERTIFICATE OF CORRECTION

PATENT NO. : 4,112,197

DATED : September 5, 1978

INVENTOR(S) : W. Peter Metz

It is certified that error appears in the above-identified patent and that said Letters Patent are hereby corrected as shown below:

Column 8, line 67, the numeral "3-1/2." should read

-- 3-1/2". --.

Signed and Sealed this

*Third* Day of *April 1979*

[SEAL]

*Attest:*

RUTH C. MASON
*Attesting Officer*

DONALD W. BANNER
*Commissioner of Patents and Trademarks*